US009300055B2

(12) United States Patent
Tseng et al.

(10) Patent No.: US 9,300,055 B2
(45) Date of Patent: Mar. 29, 2016

(54) MOBILE DEVICE WITH TWO ANTENNAS AND ANTENNA SWITCH MODULES

(71) Applicant: Acer Incorporated, New Taipei (TW)

(72) Inventors: Kuo-Hua Tseng, New Taipei (TW); Chih-Hua Chang, New Taipei (TW); Shao-Yu Huang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 358 days.

(21) Appl. No.: 13/951,380

(22) Filed: Jul. 25, 2013

(65) Prior Publication Data

US 2014/0198012 A1 Jul. 17, 2014

(30) Foreign Application Priority Data

Jan. 14, 2013 (TW) ..... 102101301 A

(51) Int. Cl.

| | |
|---|---|
| ***H01Q 3/24*** | (2006.01) |
| ***H01Q 21/28*** | (2006.01) |
| ***H01Q 1/24*** | (2006.01) |
| ***H01Q 9/42*** | (2006.01) |
| ***H01Q 21/30*** | (2006.01) |

(52) U.S. Cl.

CPC ..... *H01Q 21/28* (2013.01); *H01Q 1/243* (2013.01); *H01Q 9/42* (2013.01); *H01Q 21/30* (2013.01)

(58) Field of Classification Search

CPC ..... H01Q 21/28; H01Q 21/30; H01Q 29/42; H01Q 1/243

See application file for complete search history.

(56) References Cited

U.S. PATENT DOCUMENTS

| | | | | |
|---|---|---|---|---|
| 8,138,977 | B2 | 3/2012 | Zhang et al. | |
| 8,154,460 | B2 * | 4/2012 | Sakata | H01Q 1/243 343/702 |
| 8,237,519 | B2 | 8/2012 | Achour | |
| 2007/0176836 | A1 * | 8/2007 | Abramov | H01Q 1/2291 343/702 |
| 2012/0306718 | A1 | 12/2012 | Koyanagi et al. | |

FOREIGN PATENT DOCUMENTS

| | | |
|---|---|---|
| TW | 200737597 | 10/2001 |
| TW | 200913370 | 3/2009 |
| TW | 200950363 | 12/2009 |
| WO | WO 2012/125176 | 9/2012 |

OTHER PUBLICATIONS

Chinese language office action dated Sep. 2, 2015, issued in application No. TW 102101301.

* cited by examiner

*Primary Examiner* — Trinh Dinh

(74) *Attorney, Agent, or Firm* — McClure, Qualey & Rodack, LLP

(57) ABSTRACT

A mobile device includes a system circuit board, a ground element, a communication module, a first antenna, a second antenna, a first ASM (Antenna Switch Module), and a second ASM. The first antenna is configured to receive or transmit a first signal in a first frequency band. The second antenna is configured to receive or transmit a second signal in a second frequency band. The second frequency band is different from the first frequency band. The first ASM is coupled between the first antenna and the communication module, and is configured to separate frequencies of the first signal. The second ASM is coupled between the second antenna and the communication module, and is configured to separate frequencies of the second signal.

14 Claims, 8 Drawing Sheets

MOBILE DEVICE WITH TWO ANTENNAS AND ANTENNA SWITCH MODULES

CROSS REFERENCE TO RELATED APPLICATIONS

This application claims priority of Taiwan Patent Application No. 102101301 filed on Jan. 14, 2013, the entirety of which is incorporated by reference herein.

BACKGROUND OF THE INVENTION

1. Field of the Invention

The disclosure generally relates to a mobile device, and more particularly, relates to a mobile device comprising two antennas.

2. Description of the Related Art

With the development of mobile communication devices, a variety of mobile communication devices have been introduced. Today, mobile communication devices may be classified into three types: smart phones, tablet computers, and notebook computers. In order to provide high transmission speeds for data and high quality images, the LTE (Long Term Evolution) standard has been developed for the next generation of mobile communication devices. The frequency range of the LTE is from the low frequency bands of 700 MHz to high frequency bands of 2690 MHz, and covers more than 10 application frequency bands. LTE communication systems are different from conventional 2G/3G communication systems, and they have specific application frequency bands for each country and location. Since the application frequency bands are not uniform, conventional portable LTE devices with a single design cannot be used all over the world.

It is very difficult to design a multi-band antenna which covers the LTE, 2G and 3G frequency bands, without increasing the size and complexity of today's mobile communication devices. When designing a multi-band antenna which covers the LTE, 2G and 3G frequency bands, at least seven frequency bands must be covered, which is difficult. Currently, a single antenna is used to cover several frequency bands. However, due to the techniques of achieving the LTE frequency, the performances of the 2G/3G frequency bands are degraded. Basically, mutual coupling between radiation elements of different frequency bands in the single antenna occur.

BRIEF SUMMARY OF THE INVENTION

In one exemplary embodiment, the disclosure is directed to a mobile device, comprising: a system circuit board; a ground element, disposed on the system circuit board; a communication module; a first antenna, configured to receive or transmit a first signal in a first frequency band; a second antenna, configured to receive or transmit a second signal in a second frequency band, wherein the second frequency band is different from the first frequency band; a first ASM (Antenna Switch Module), coupled between the communication module and the first antenna, and configured to separate frequencies of the first signal; and a second ASM, coupled between the communication module and the second antenna, and configured to separate frequencies of the second signal, wherein the first antenna has a first projection on the system circuit board, and the second antenna has a second projection on the system circuit board, and neither the first projection nor the second projection overlaps with the ground element.

In another exemplary embodiment, the disclosure is directed to a mobile device, comprising: a system circuit board; a ground element, disposed on the system circuit board; a communication module; a first antenna, configured to receive or transmit a first signal in a first frequency band; a second antenna, configured to receive or transmit a second signal in a second frequency band, wherein the second frequency band is different from the first frequency band; and an ASM (Antenna Switch Module), wherein the first antenna and the second antenna are both coupled through the ASM to the communication module, and the ASM is configured to separate frequencies of the first signal and/or frequencies of the second signal, wherein the first antenna has a first projection on the system circuit board, and the second antenna has a second projection on the system circuit board, and neither the first projection nor the second projection overlaps with the ground element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof in the invention are shown in detail as follows.

Figure 1:
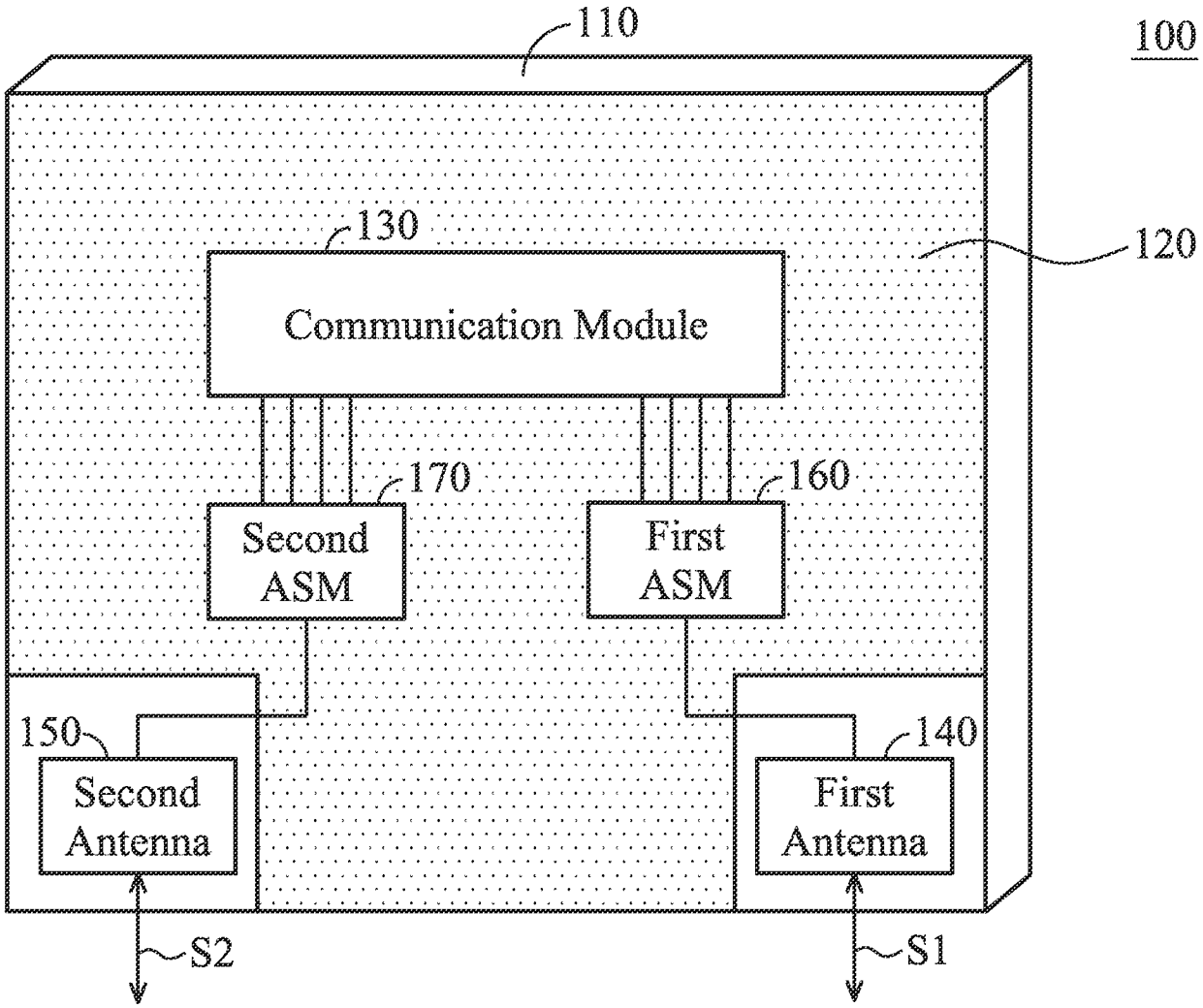
FIG. 1 is a diagram for illustrating a mobile device according to an embodiment of the invention.

FIG. 1 is a diagram for illustrating a mobile device 100 according to an embodiment of the invention. The mobile device 100 may be a smart phone, a tablet computer, or a notebook computer. As shown in FIG. 1, the mobile device 100 comprises a system circuit board 110, a ground element 120, a communication module 130, a first antenna 140, a second antenna 150, a first ASM (Antenna Switch Module) 160, and a second ASM 170. Note that the mobile device 100 may further comprise other components, such as a processor, a camera module, a touch control panel, a touch control module, a battery, and a housing (not shown).

The system circuit board 110 may be a dielectric substrate, such as an FR4 substrate. The ground element 120 may be a ground plane, which is disposed on the system circuit board 110 and is made of metal, such as copper, silver, or aluminum. The communication module 130 is configured to perform a signal-processing procedure. The first antenna 140 is configured to receive or transmit a first signal S1 in a first frequency band. The second antenna 150 is configured to receive or transmit a second signal S2 in a second frequency band. The second frequency band may be different from the first frequency band. In some embodiments, the first frequency band covers WWAN (Wireless Wide Area Network) frequency bands, and the second frequency band covers LTE (Long Term Evolution) frequency bands. The types of the first antenna 140 and the second antenna 150 are not limited in the invention. For example, any of the first antenna 140 and the second antenna 150 may be a monopole antenna, a loop antenna, a PIFA (Planar Inverted F Antenna), a patch antenna, or a chip antenna. The first antenna 140 and the second antenna 150 may be substantially disposed at two opposite corners of an edge of the system circuit board 110, respectively. In some embodiments, the first antenna 140 and the second antenna 150 are disposed on a surface of the system circuit board 110, or are substantially separated from the system circuit board 110. In a preferred embodiment, the first antenna 140 has a first projection on the system circuit board 110, and the second antenna 150 has a second projection on the system circuit board 110, wherein neither the first projection nor the second projection overlaps with the ground element 120. In other words, the first antenna 140 and the second antenna 150 are disposed on a non-grounding area of the system circuit board 110. The first ASM 160 is coupled between the communication module 130 and the first antenna 140, and is configured to separate frequencies of the first signal S1. The second ASM 170 is coupled between the communication module 130 and the second antenna 150, and is configured to separate frequencies of the second signal S2. Each of the first ASM 160 and the second ASM 170 may be a one-input multi-output converter, and/or a multi-input one-output converter. Accordingly, the mobile device 100 can operate in multiple frequency bands easily.

In a preferred embodiment, the mobile device 100 of the invention uses a dual antenna system to respectively cover WWAN and LTE frequency bands. Since each antenna covers a relatively small frequency range, an antenna designer can easily design the dual antenna system and fine tune the radiation performance thereof. With an appropriate design, the dual antenna system of the invention occupies less space than a conventional single antenna system does. In addition, the adjustment of one antenna of the dual antenna system does not influence the radiation performance of another antenna of the dual antenna system, and the two antennas can operate independently without interfering with each other.

Figure 2A:
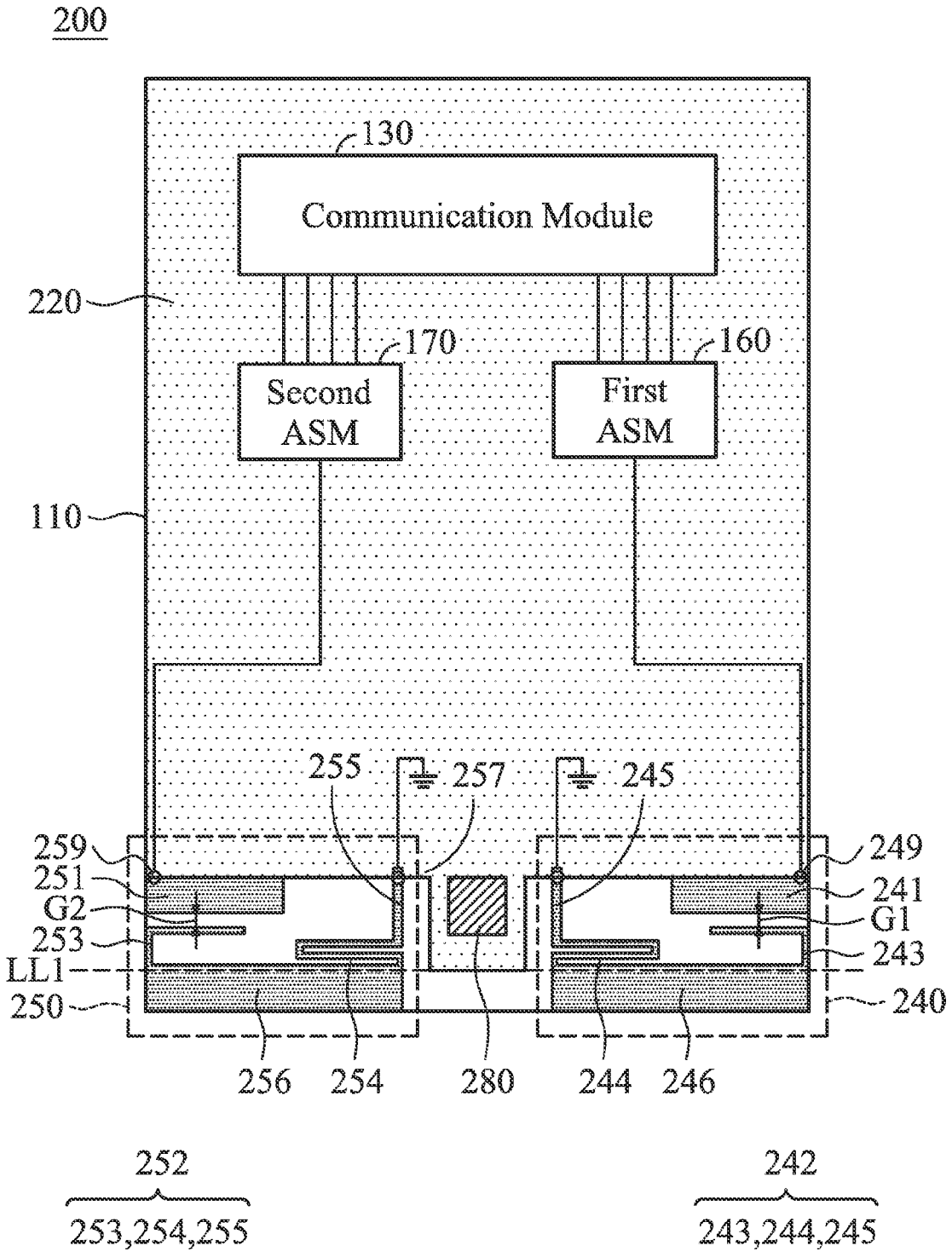
FIG. 2A is a flat diagram for illustrating a mobile device according to an embodiment of the invention.
Figure 2B:
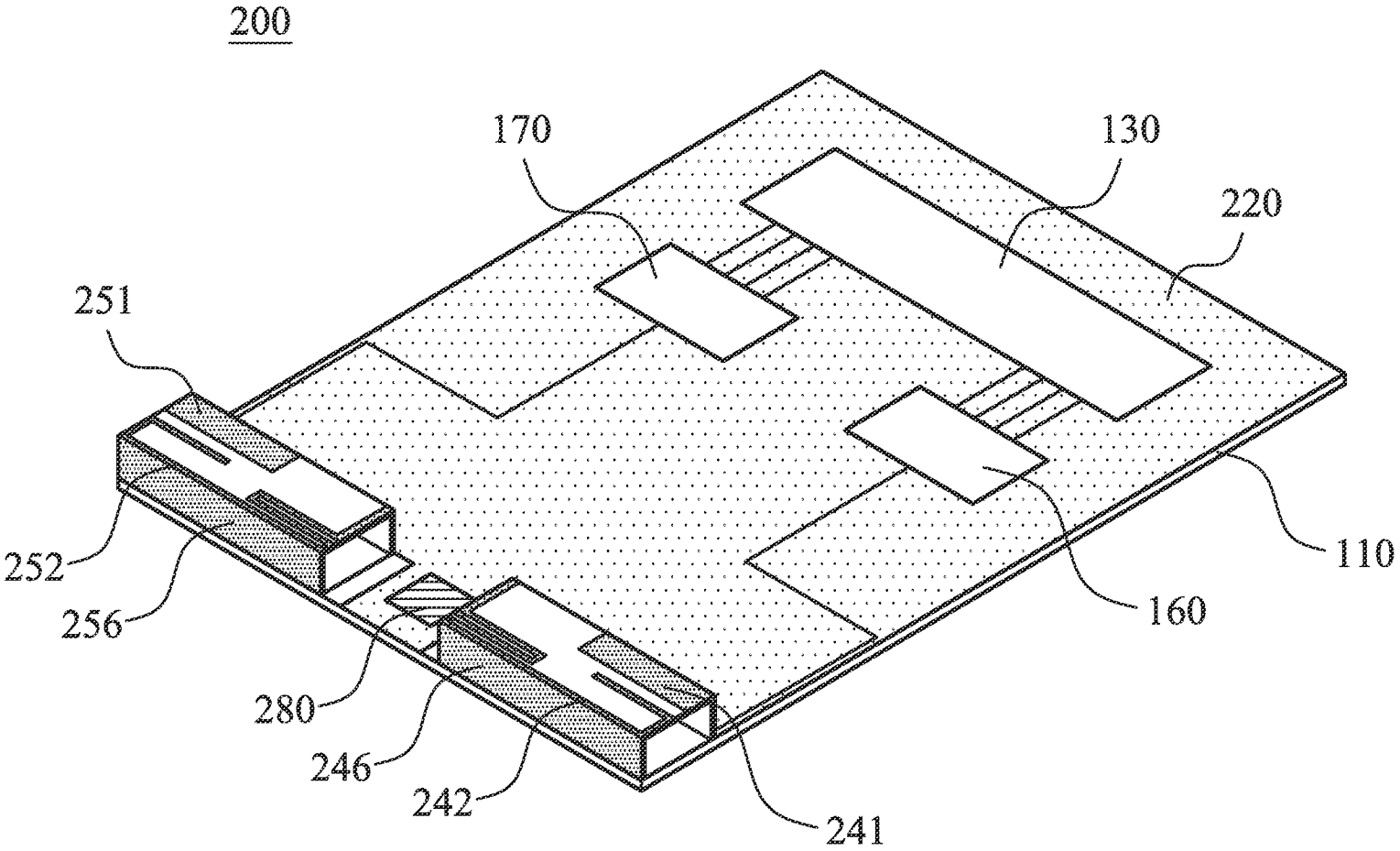
FIG. 2B is a perspective view for illustrating a mobile device according to an embodiment of the invention.

FIG. 2A is a flat diagram for illustrating a mobile device 200 according to an embodiment of the invention. FIG. 2B is a perspective view for illustrating the mobile device 200 according to an embodiment of the invention. As shown in FIGS. 2A and 2B, in the mobile device 200, each of a first antenna 240 and a second antenna 250 forms a three-dimensional structure on the system circuit board 110. Refer to FIGS. 2A and 2B together. Detailed features of the first antenna 240 and the second antenna 250 will be described in the following embodiment.

The first antenna 240 comprises a first feeding element 241, a first radiation element 242, and a first extension element 246. The first feeding element 241 is coupled through the first ASM 160 to the communication module 130. The first feeding element 241 may substantially have a rectangular shape, and a first feeding point 249 of the first feeding element 241 is positioned at a corner of the rectangular shape. In some embodiments, the first feeding point 249 of the first feeding element 241 is coupled through a pogo pin or a metal spring (not shown) to the first ASM 160 disposed on the system circuit board 110. The first radiation element 242 is separated from the first feeding element 241. One end of the first radiation element 242 is coupled to a ground element 220 (e.g., through a pogo pin or a metal spring), and a first coupling gap G1 is formed between the other end of the first radiation element 242 and the first feeding element 241. The first extension element 246 is coupled to the first radiation element 242. The first extension element 246 may substantially have a rectangular shape.

The first radiation element 242 comprises a meandering structure. More particularly, the first radiation element 242 comprises a first portion 243, a second portion 244, and a third portion 245. The first portion 243 is coupled through the second portion 244 to the third portion 245. In some embodiments, the first portion 243 substantially has a U-shape, the second portion 244 substantially has an inverted S-shape, and the third portion 245 substantially has an I-shape. The first extension element 246 is coupled to an edge of the first portion 243 and an edge of the second portion 244. In some embodiments, the first extension element 246 is bent along the bent line LL1 of FIG. 2A such that the first radiation element 242 and the first extension element 246 are substantially disposed on two perpendicular planes, respectively.

The second antenna 250 comprises a second feeding element 251, a second radiation element 252, a second extension element 256, and an inductor 257. The inductor 257 may be a chip inductor for providing an additional resonant length. The second feeding element 251 is coupled through the second ASM 170 to the communication module 130. The second feeding element 251 may substantially have a rectangular shape, and a second feeding point 259 of the second feeding element 251 is positioned at a corner of the rectangular shape. In some embodiments, the second feeding point 259 of the second feeding element 251 is coupled through a pogo pin or a metal spring (not shown) to the second ASM 170 disposed on the system circuit board 110. The second radiation element 252 is separated from the second feeding element 251. One end of the second radiation element 252 is coupled through the inductor 257 to the ground element 220 (e.g., further through a pogo pin or a metal spring), and a second coupling gap G2 is formed between the other end of the second radiation element 252 and the second feeding element 251. The second extension element 256 is coupled to the second radiation element 252. The second extension element 256 may substantially have a rectangular shape.

The second radiation element 252 comprises a meandering structure. More particularly, the second radiation element 252 comprises a fourth portion 253, a fifth portion 254, and a sixth portion 255. The fourth portion 253 is coupled through the fifth portion 254 to the sixth portion 255. In some embodiments, the fourth portion 253 substantially has a U-shape, the fifth portion 254 substantially has an S-shape, and the sixth portion 255 substantially has an I-shape. The second extension element 256 is coupled to an edge of the fourth portion 253 and an edge of the fifth portion 254. In some embodiments, the second extension element 256 is bent along the bent line LL1 of FIG. 2A such that the second radiation element 252 and the second extension element 256 are substantially disposed on two perpendicular planes, respectively.

In some embodiments, the mobile device 200 further comprises an electronic component 280, which is disposed on the system circuit board 110 and between the first antenna 240 and the second antenna 250. For example, the electronic component 280 may be a USB (Universal Serial Bus) socket, a camera lens, an LED (Light-Emitting Diode), or a speaker.

Figure 3:
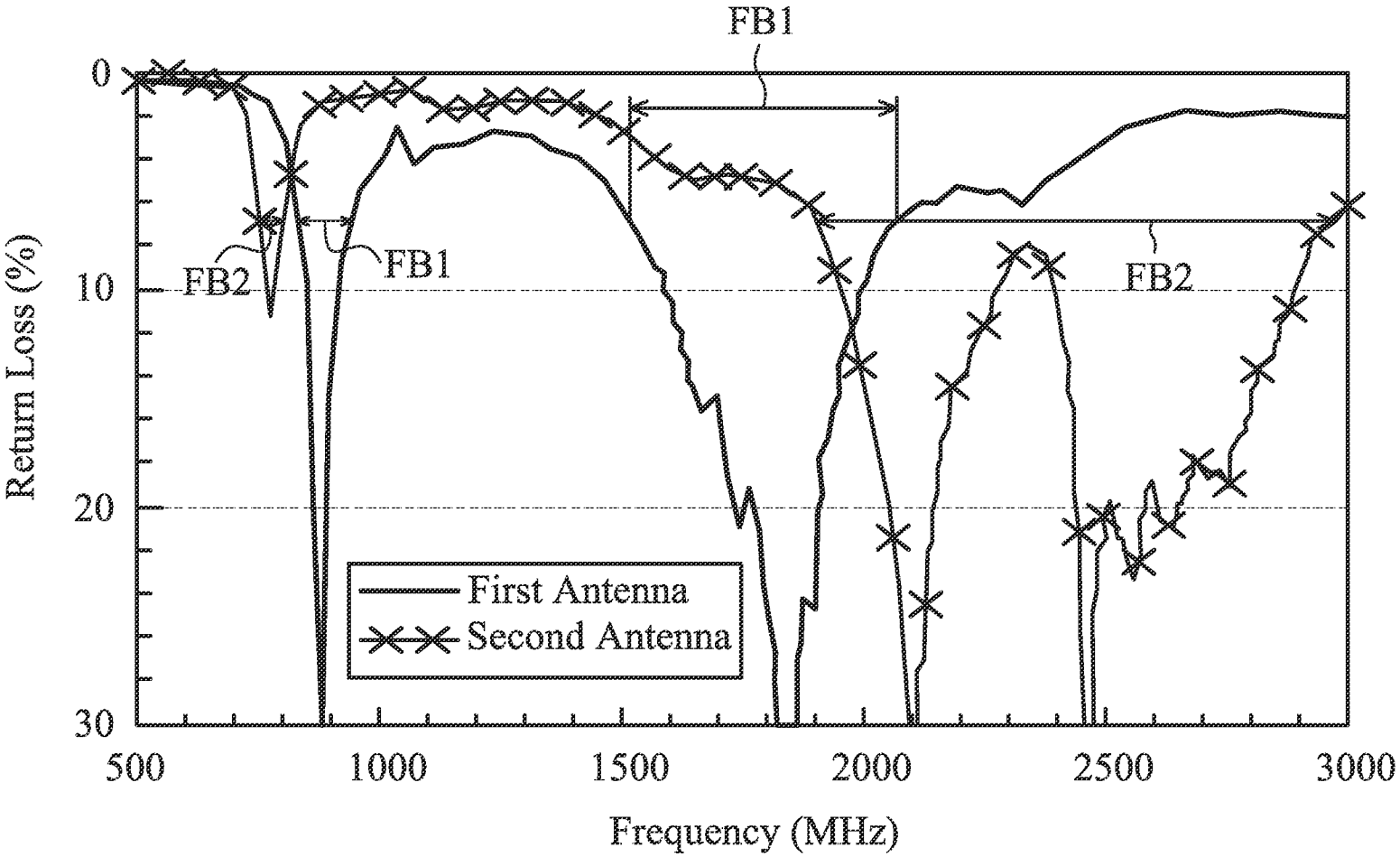
FIG. 3 is a diagram for illustrating return loss of a first antenna and a second antenna of a mobile device according to an embodiment of the invention.

FIG. 3 is a diagram for illustrating return loss of the first antenna 240 and the second antenna 250 of the mobile device 200 according to an embodiment of the invention. The horizontal axis represents operation frequency (MHz), and the vertical axis represents the return loss (dB). As shown in FIG. 3, the first antenna 240 is excited to generate a first frequency band FB1, and the second antenna 250 is excited to generate a second frequency band FB2. In a preferred embodiment, the first frequency band FB1 is approximately from 824 MHz to 960 MHz and further from 1710 MHz to 2170 MHz, and the second frequency band FB2 is approximately from 747 MHz to 787 MHz and further from 1710 MHz to 2690 MHz. Accordingly, the first antenna 240 covers at least some 2G/3G frequency bands, and the second antenna 250 covers at least some LTE frequency bands.

Figure 4:
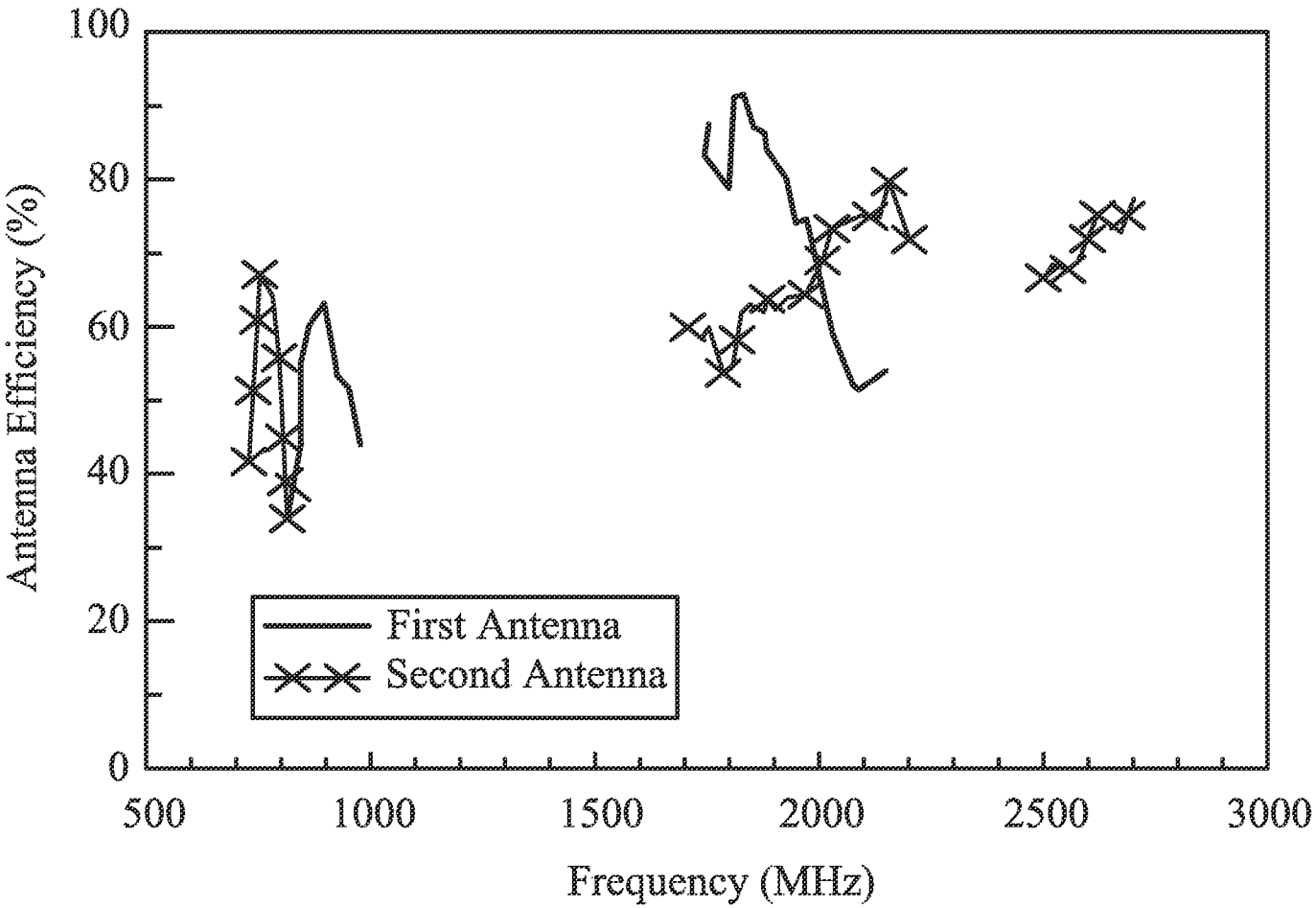
FIG. 4 is a diagram for illustrating antenna efficiency of a first antenna and a second antenna of a mobile device according to an embodiment of the invention.

FIG. 4 is a diagram for illustrating antenna efficiency of the first antenna 240 and the second antenna 250 of the mobile device 200 according to an embodiment of the invention. The horizontal axis represents operation frequency (MHz), and the vertical axis represents the antenna efficiency (%). As shown in FIG. 4, the antenna efficiency of the first antenna 240 is approximately from 35% to 90% in the first frequency band FB1, and the antenna efficiency of the second antenna 250 is approximately from 40% to 80% in the second frequency band FB2. Accordingly, the antenna efficiency of the mobile device 200 can meet requirements of practical applications.

Figure 5:
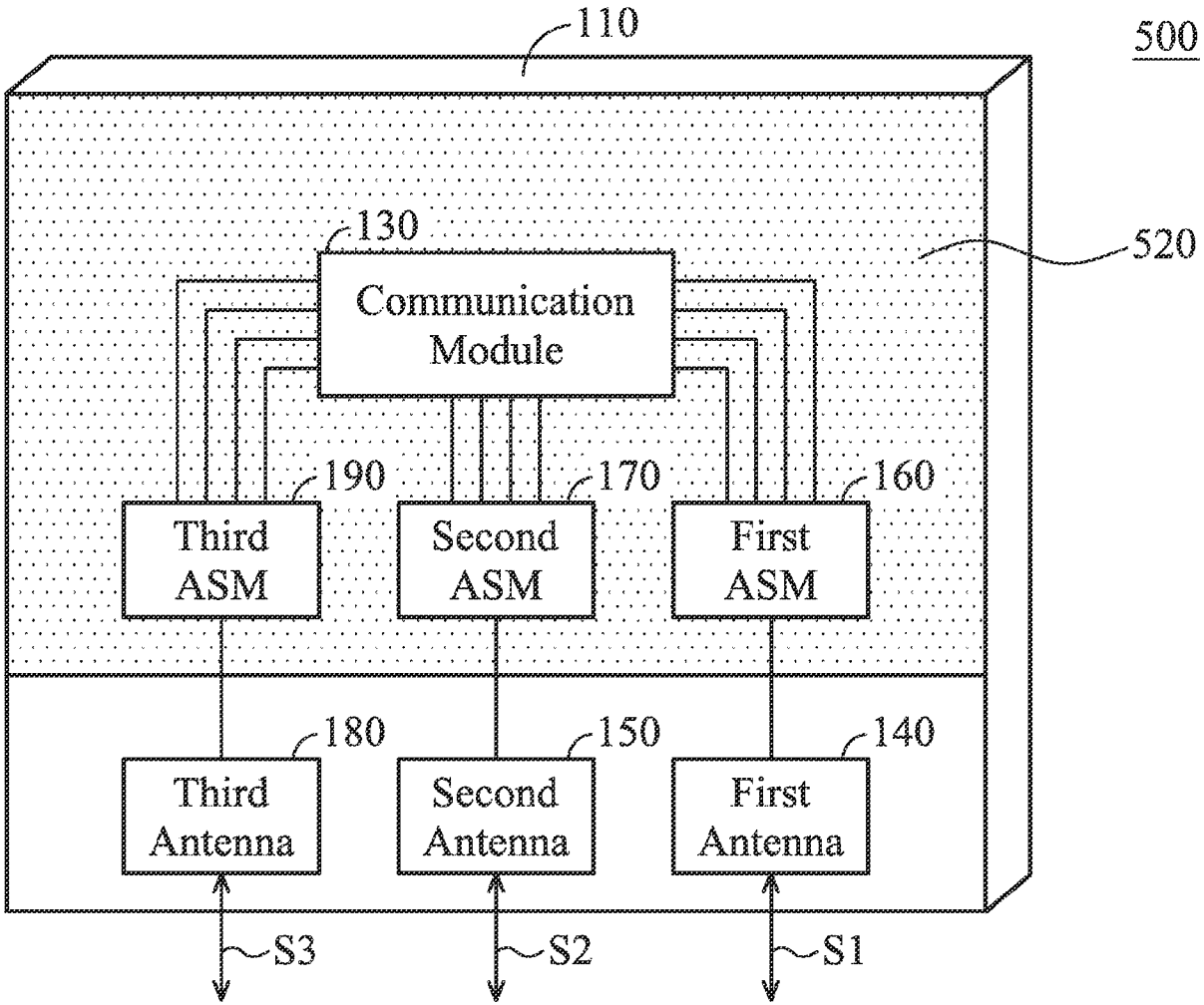
FIG. 5 is a diagram for illustrating a mobile device according to an embodiment of the invention.

FIG. 5 is a diagram for illustrating a mobile device 500 according to an embodiment of the invention. FIG. 5 is similar to FIG. 1. The difference between the two embodiments is that the mobile device 500 further comprises a third antenna 180 and a third ASM 190. The third antenna 180 is configured to receive or transmit a third signal S3 in a third frequency band. The third frequency band is different from the mentioned first frequency band and second frequency band. The third ASM 190 is coupled between the communication module 130 and the third antenna 180, and is configured to separate frequencies of the third signal S3. The third ASM 190 may be a one-input multi-output converter, and/or a multi-input one-output converter. Similarly, the third antenna 180 has a third projection on the system circuit board 110, and the third projection does not overlap with a ground element 520. Note that the mobile device 500 may further comprise four or more antennas and ASMs. Other features of the mobile device 500 of FIG. 5 are similar to those of the mobile device 100 of FIG. 1. Accordingly, the two embodiments can achieve similar performances.

Figure 6:
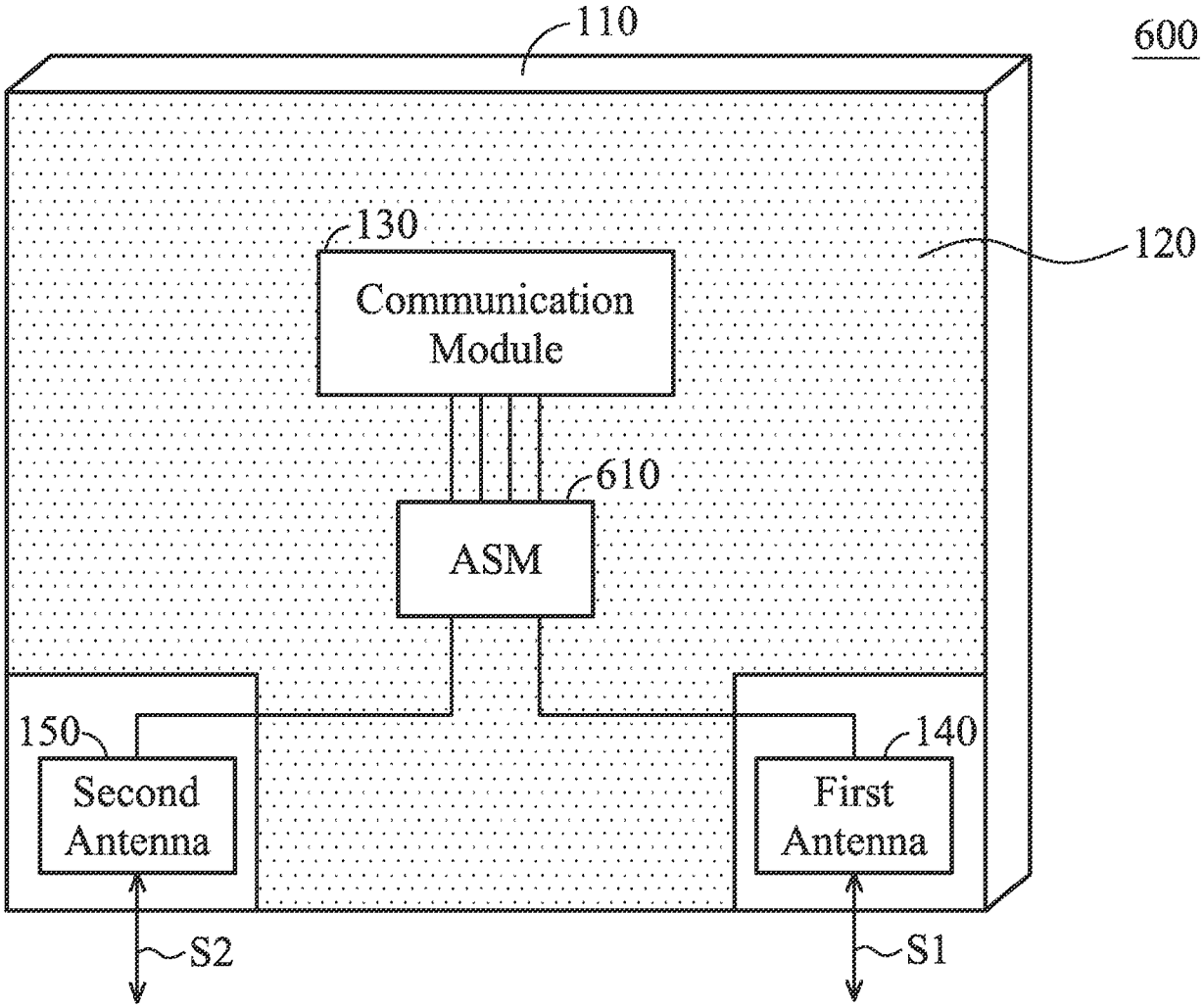
FIG. 6 is a diagram for illustrating a mobile device according to an embodiment of the invention.

FIG. 6 is a diagram for illustrating a mobile device 600 according to an embodiment of the invention. FIG. 6 is similar to FIG. 1. The difference between the two embodiments is that the mobile device 600 merely comprises a single ASM 610 and the first antenna 140 and the second antenna 150 are both coupled through the ASM 610 to the communication module 130. The ASM 610 is configured to separate frequencies of the first signal S1 and frequencies of the second signal S2. In the embodiment, the ASM 610 may be a two-input multi-output converter, and/or a multi-input two-output converter. Other features of the mobile device 600 of FIG. 6 are similar to those of the mobile device 100 of FIG. 1. Accordingly, the two embodiments can achieve similar performances.

Figure 7:
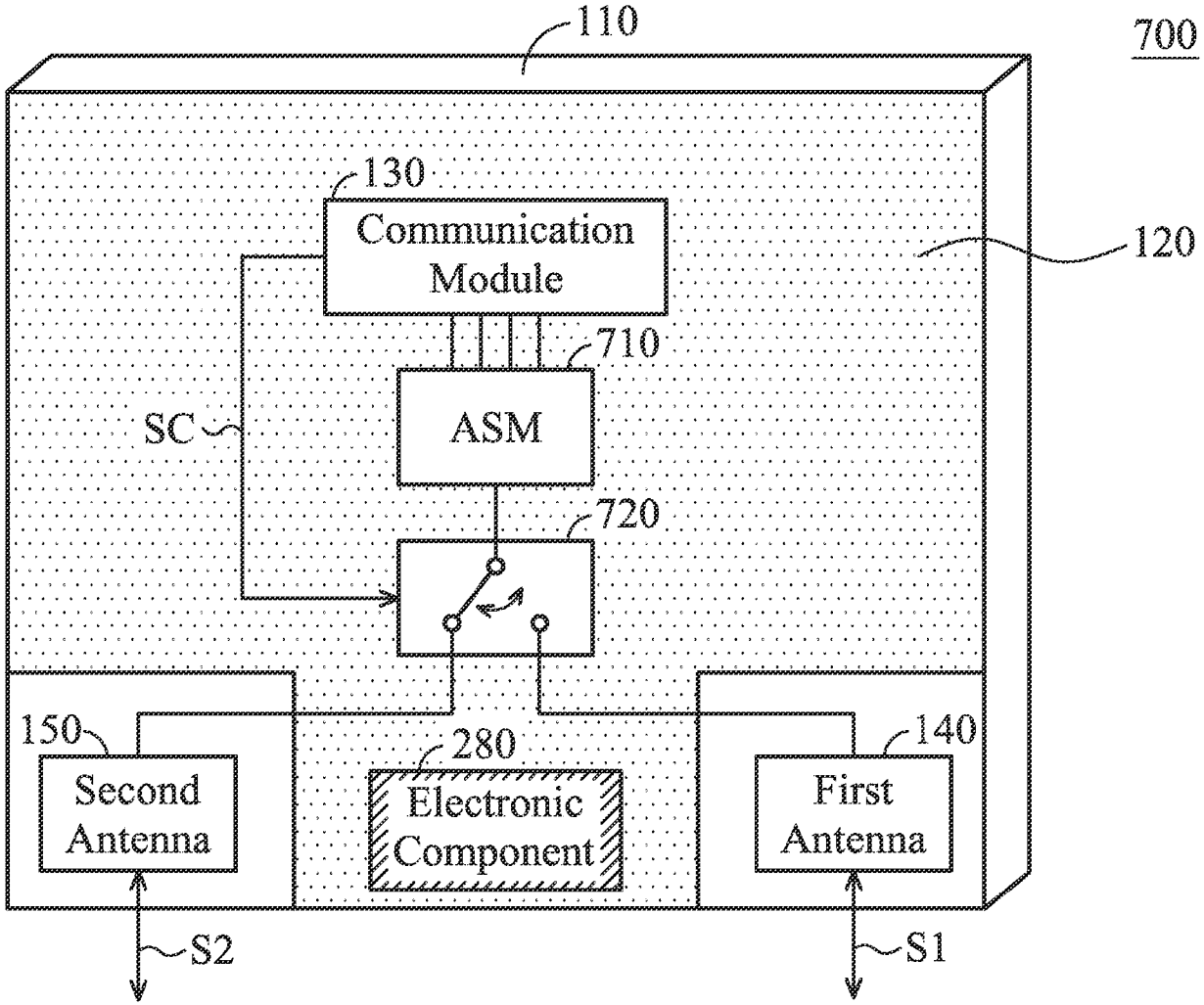
FIG. 7 is a diagram for illustrating a mobile device according to an embodiment of the invention.

FIG. 7 is a diagram for illustrating a mobile device 700 according to an embodiment of the invention. FIG. 7 is similar to FIG. 1. The difference between the two embodiments is that the mobile device 700 merely comprises a single ASM 710 and further comprises a switch 720. The switch 720 selectively couples either the first antenna 140 or the second antenna 150 to the ASM 710 according to a control signal SC from the communication module 130. The ASM 710 is configured to separate frequencies of the first signal S1 or frequencies of the second signal S2. In the embodiment, the ASM 710 may be a one-input multi-output converter, and/or a multi-input one-output converter. Other features of the mobile device 700 of FIG. 7 are similar to those of the mobile device 100 of FIG. 1. Accordingly, the two embodiments can achieve similar performances.

In some embodiments, element sizes and element parameters of the invention are as follows. Refer to FIGS. 2A and 2B together again. The ground element 220 has a length of about 110 mm and a width of about 70 mm. The first antenna 240 has a length of about 30 mm and a width of about 10 mm. The second antenna 250 has a length of about 30 mm and a width of about 10 mm. The first antenna 240 and the second antenna 250 may be formed on a bent FR4 substrate having a thickness of about 0.8 mm. The first antenna 240 and the second antenna 250 have a total height of about 5 mm on the system circuit board 110. The inductor 257 has an inductance of about 13 nH. The system circuit board 110 has a dielectric constant of about 4.4.

Note that the above element sizes, element shapes, element parameters, and frequency ranges are not limitations of the invention. An antenna designer may adjust these settings according to different requirements. In addition, the detailed features of the first antenna 240 and the second antenna 250 of FIGS. 2A and 2B may be applied to the embodiments of FIGS. 1, 5, 6, and 7.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a system circuit board;

a ground element, disposed on the system circuit board;

a communication module;

a first antenna, configured to receive or transmit a first signal in a first frequency band;

a second antenna, configured to receive or transmit a second signal in a second frequency band, wherein the second frequency band is different from the first frequency band;

a first ASM (Antenna Switch Module), coupled between the communication module and the first antenna, and configured to separate frequencies of the first signal; and a second ASM, coupled between the communication module and the second antenna, and configured to separate frequencies of the second signal, wherein the first antenna has a first projection on the system circuit board, and the second antenna has a second projection on the system circuit board, and neither the first projection nor the second projection overlaps with the ground element;

wherein the first antenna comprises:

a first feeding element, coupled through the first ASM to the communication module;

a first radiation element, separated from the first feeding element, wherein one end of the first radiation element is coupled to the ground element, and a first coupling gap is formed between the other end of the first radiation element and the first feeding element; and a first extension element, coupled to the first radiation element.

2. The mobile device as claimed in claim 1, wherein the first radiation element comprises a first portion, a second portion, and a third portion, wherein the first portion substantially has a U-shape, the second portion substantially has an inverted S-shape, the third portion substantially has an I-shape, and the first portion is coupled through the second portion to the third portion.

3. The mobile device as claimed in claim 2, wherein the first extension element is coupled to an edge of the first portion and an edge of the second portion, and wherein the first radiation element and the first extension element are substantially disposed on two perpendicular planes, respectively.

4. The mobile device as claimed in claim 1, wherein the second antenna comprises:

a second feeding element, coupled through the second ASM to the communication module;

an inductor;

a second radiation element, separated from the second feeding element, wherein one end of the second radiation element is coupled through the inductor to the ground element, and a second coupling gap is formed between the other end of the second radiation element and the second feeding element; and a second extension element, coupled to the second radiation element.

5. The mobile device as claimed in claim 4, wherein the second radiation element comprises a fourth portion, a fifth portion, and a sixth portion, wherein the fourth portion substantially has a U-shape, the fifth portion substantially has an S-shape, the sixth portion substantially has an I-shape, and the fourth portion is coupled through the fifth portion to the sixth portion.

6. The mobile device as claimed in claim 5, wherein the second extension element is coupled to an edge of the fourth portion and an edge of the fifth portion, and wherein the second radiation element and the second extension element are substantially disposed on two perpendicular planes, respectively.

7. The mobile device as claimed in claim 1, further comprising:

a third antenna, configured to receive or transmit a third signal in a third frequency band, wherein the third frequency band is different from the first frequency band and the second frequency band; and a third ASM, coupled between the communication module and the third antenna, and configured to separate frequencies of the third signal, wherein the third antenna has a third projection on the system circuit board, and the third projection does not overlap with the ground element.

8. A mobile device, comprising:

a system circuit board;

a ground element, disposed on the system circuit board;

a communication module;

a first antenna, configured to receive or transmit a first signal in a first frequency band;

a second antenna, configured to receive or transmit a second signal in a second frequency band, wherein the second frequency band is different from the first frequency band;

a first ASM (Antenna Switch Module), coupled between the communication module and the first antenna, and configured to separate frequencies of the first signal; and a second ASM, coupled between the communication module and the second antenna, and configured to separate frequencies of the second signal, wherein the first antenna has a first projection on the system circuit board, and the second antenna has a second projection on the system circuit board, and neither the first projection nor the second projection overlaps with the ground element;

wherein the second antenna comprises:

a second feeding element, coupled through the second ASM to the communication module;

an inductor;

a second radiation element, separated from the second feeding element, wherein one end of the second radiation element is coupled through the inductor to the ground element, and a second coupling gap is formed between the other end of the second radiation element and the second feeding element; and a second extension element, coupled to the second radiation element.

9. The mobile device as claimed in claim 8, wherein the second radiation element comprises a fourth portion, a fifth portion, and a sixth portion, wherein the fourth portion substantially has a U-shape, the fifth portion substantially has an S-shape, the sixth portion substantially has an I-shape, and the fourth portion is coupled through the fifth portion to the sixth portion.

10. The mobile device as claimed in claim 9, wherein the second extension element is coupled to an edge of the fourth portion and an edge of the fifth portion, and wherein the second radiation element and the second extension element are substantially disposed on two perpendicular planes, respectively.

11. The mobile device as claimed in claim 8, wherein the first antenna comprises:

a first feeding element, coupled through the first ASM to the communication module;

a first radiation element, separated from the first feeding element, wherein one end of the first radiation element is coupled to the ground element, and a first coupling gap is formed between the other end of the first radiation element and the first feeding element; and a first extension element, coupled to the first radiation element.

12. The mobile device as claimed in claim 11, wherein the first radiation element comprises a first portion, a second portion, and a third portion, wherein the first portion substantially has a U-shape, the second portion substantially has an inverted S-shape, the third portion substantially has an I-shape, and the first portion is coupled through the second portion to the third portion.

13. The mobile device as claimed in claim 12, wherein the first extension element is coupled to an edge of the first portion and an edge of the second portion, and wherein the first radiation element and the first extension element are substantially disposed on two perpendicular planes, respectively.

14. The mobile device as claimed in claim 8, further comprising:

a third antenna, configured to receive or transmit a third signal in a third frequency band, wherein the third frequency band is different from the first frequency band and the second frequency band; and a third ASM, coupled between the communication module and the third antenna, and configured to separate frequencies of the third signal, wherein the third antenna has a third projection on the system circuit board, and the third projection does not overlap with the ground element.

* * * * *